US005293148A

United States Patent [19]

Hancock

[11] Patent Number: 5,293,148

[45] Date of Patent: Mar. 8, 1994

[54] HIGH RESOLUTION RESISTOR LADDER NETWORK WITH REDUCED NUMBER OF RESISTOR ELEMENTS

[75] Inventor: Peter G. Hancock, Plano, Tex.

[73] Assignee: Honeywell Inc., Minneapolis, Minn.

[21] Appl. No.: 912,936

[22] Filed: Jul. 13, 1992

[51] Int. Cl.[5] ..... H01C 7/22

[52] U.S. Cl. ..... 338/295; 338/260; 338/320

[58] Field of Search ..... 338/260, 295, 293, 320, 338/307, 308

[56] References Cited

U.S. PATENT DOCUMENTS

| | | | |
|---|---|---|---|
| Re. 29,676 | 6/1978 | Hareyama et al. | 338/320 X |
| 4,337,390 | 6/1982 | Best | 338/295 X |
| 4,626,804 | 12/1984 | Risher et al. | 338/320 X |
| 4,703,302 | 10/1987 | Hino et al. | 338/293 |
| 4,782,320 | 11/1988 | Shier | 338/295 |
| 4,859,980 | 8/1989 | Hammond | 338/308 |

*Primary Examiner*—Marvin M. Lateef

*Attorney, Agent, or Firm*—William D. Lanyi

[57] ABSTRACT

A resistor network is provided which significantly reduces the total number of resistors required to achieve a given resolution. It comprises a cell of resistors that consists of a nonbinary number of resistors that is not evenly divisible by an integer power of two and is specifically selected to permit the group of resistors to be sequentially reduced to subgroups, or combinations, of resistors which yield a plurality of subgroup resistances that differ from preceding or subsequent subgroup resistances by a generally equivalent differential. The cell of resistors is combined with a plurality of resistor cells that consist of binary numbers of resistors in a conventional resistor ladder format. When combined with the binary resistor cells, the cell consisting of a nonbinary number of resistors provides a substantially similar resolution with a significant reduction in the number of resistors required. One embodiment of the present invention permits the resolution of a sixty-two resistor ladder to be simulated by a ladder that comprises only twenty-three resistors.

19 Claims, 8 Drawing Sheets

HIGH RESOLUTION RESISTOR LADDER NETWORK WITH REDUCED NUMBER OF RESISTOR ELEMENTS

BACKGROUND OF THE INVENTION

1. Field of the Invention

The present invention relates generally to resistor network circuits and, more particularly, to a resistor network that comprises a plurality of resistor ladders in which the number of resistors in each ladder is related to the number of resistors in at least one other ladder by a factor of two to form a binary progression and, in addition, an arrangement of resistors in an additional ladder which consists of a nonbinary number of resistors which is reducible in stages to a plurality of combinations which each have a resistance that is related to the resistances of the other combinations in a manner that results in a plurality of resistance differences between combinations that are sufficiently equivalent to each other to provide a series of incremental resistive steps which are monotonic and which provide a greater resolution than any of the other resistors ladders.

2. Description of the Prior Art

In the field of miniaturized electronics, it is often necessary to select the value of a component, such as a resistor, so that the performance of a circuit is optimized to meet certain requirements. To reduce the cost of these components, methods have been developed which utilize film resistors that are made from resistive paste or ink. These resistive areas of a circuit can be cut by laser trimming to obtain a desired resistive value. In integrated circuits, the trimmable resistive components are included on the silicon chip by depositing films of resistive material on silicon areas and trimming the resistive material with lasers which are integral to the wafer probing system that is used to inspect and test the operation of the integrated circuit.

One possible technique for setting the precise resistance of a resistor network is to measure the resistance of the network, compare that resistance to a desired predetermined value and then selectively trim resistors in order to achieve the necessary change in resistance. The resulting resistance could then again be measured to determine if additional trimming is necessary. This technique is disadvantageous when high volume production rates are desired. It has therefore been replaced by higher speed methods which calculate the precise resistors that should be cut and then trim those resistors to achieve the desired resistance in one step.

The use of resistor networks for the purpose of providing the high resolution resistive trimming of electronic circuits is well known to those skilled in the art. In a typical application of the known techniques, a plurality of resistor ladders is arranged in series association with each other and each of the resistor ladders consists of a preselected number of parallel connected resistors. Each one of the resistors in each of the ladders is removable, by trimming or severing, from its associated ladder.

In the newer methods of providing a trimmable resistive network, the network is arranged in such a way that the effects of cutting or trimming in the most significant cell, or ladder, are twice the effect of cutting in the next cell and so on. These binary weighted trimming techniques, using resistor ladder networks such as those described immediately above, are very well know in the art and result in fast and highly predictable resistance trimming.

In a typical application of modern integrated circuit techniques, a resistor network is fabricated from a series connection of several cells. Each cell comprises two identical resistive elements, which can possibly each comprise a plurality of resistive components, connected in parallel with each other and the resistive value of the resistive elements is halved as each subsequent cell is added. For example, FIG. 1 shows four exemplary cells, 10, 12, 14 and 16, connected in series between circuit points 20 and 22. The first cell 10 comprises two resistive elements, 30 and 32, which each have a value of $R_0$. The second cell 12 comprises two resistive elements, 34 and 36, which each have a resistive value of $R_0/2$. The two resistive elements, 38 and 40, of the third cell 14 each have a resistive value of $R_0/4$. The fourth cell 16 comprises two resistive elements, 42 and 44, which each have a resistive value equal to $R_0/8$. Although the cells in FIG. 1 are arranged in order, from left to right, from the cell with the highest resistive values to the cell with the lowest resistive values, it should be understood that the effective resistance between circuit points 20 and 22 is not dependent on the order in which the cells are connected in series. The cell with the highest resistive values is the most significant cell. In FIG. 1, this is the first cell 10. The next cell 12 is the second most significant cell and so on with the fifth cell 18 being the least significant cell. The relationship of the cells described above is achieved by making the resistive elements in each cell equivalent to half the resistance of the components in the next more significant cell. In other words, resistive elements 42 and 44 each have a resistive value which is one half the resistive value of components 38 and 40. As a result, the resistive components 46 and 48 of the fifth cell 18 each have a resistance equal to $R_0/16$. As will be described in greater detail below, each resistive element, 30–48, could be replaced by a plurality of individual resistors of a predetermined value to achieve equality for each resistor.

With continued reference to FIG. 1, it can be seen that the network is arranged to permit one branch of each cell to be opened or trimmed. The most significant cell 10 can therefore have a resistance value of either $R_0/2$ if both branches remain intact or $R_0$ if one of the two resistive components, 30 and 32, are cut or trimmed. The second most significant cell 12 will have a resistance value of $R_0/4$ if both resistive elements, 34 and 36, remain intact and $R_0/2$ if one of the two branches is cut. It should be clear that the change in resistance of the cells is halved in each sequential cell in FIG. 1.

$$R_{MIN}=R_0(\tfrac{1}{2}+\tfrac{1}{4}+\tfrac{1}{8}+1/16+1/32) \quad (1)$$

$$R_{MIN}=31/32 \quad (2)$$

Therefore, the network in FIG. 1 can have a minimum resistance value defined by equation 1 which can be simplified as illustrated in equation 2.

$$R_{MAX}=R_0(1+\tfrac{1}{2}+\tfrac{1}{4}+\tfrac{1}{8}+1/16) \quad (3)$$

$$R_{MAX}=R_0(31/16)=2(R_{MIN}) \quad (4)$$

$$\Delta R=R_0/32 \quad (5)$$

$$R=R_{MIN}+K(\Delta R) \quad (6)$$

$$R=R_0((K_1+1)/2+(K_2+1)/4+(K_3+1)/8+(K_4+1)/16+(K_5+1)/32) \quad (7)$$

$$V=16K_1+8K_2+4K_3+2K_4+1K_5 \quad (8)$$

The maximum possible resistance of the network shown in FIG. 1, which is achieved if one leg of each cell is trimmed, is defined by equation 3 which is simplified in equation 4. As can be seen in equation 4, the maximum resistance achievable by the network in FIG. 1 is twice the minimum resistance achievable by that network. The resolution, or the magnitude of the differential between each possible sequential value achievable by the network in FIG. 1, is defined in equation 5. The five cell network therefore has 32 distinct possible values between the minimum resistance of equation 2 and the maximum resistance of equation 4. The possible resistances are defined by equation 6, where K can be any integer between 0 and 31. These 32 possible resistance values for the network shown in FIG. 1 are illustrated in FIG. 2. As can be seen, the binary progression that is possible with the network shown in FIG. 1 provides a monotonic progression of equal steps between the minimum resistance defined in equation 2 to the maximum resistance defined in equation 4 with the resolution defined in equation 5. One skilled in the art will recognize that any value of resistance between the minimum and maximum resistances of the network can be provided within an accuracy of plus or minus one half of the resolution defined in equation 5. It should further be understood that the resistance of the network shown in FIG. 1 can be mathematically expressed as shown in equation 7, where $K_N$ is equal to zero if the Nth cell is intact and is equal to one if the Nth cell is cut or trimmed. If the values of $K_N$ are considered to be coefficients of a binary number, the decimal value of the number is represented by the relationship shown in equation 8.

$$R_N=(R_0)/(2^{N-1}) \quad (9)$$

$$\Delta R=R_0/2^N \quad (10)$$

With continued reference to FIG. 1, the concepts described above can be stated for the general case for N cells. The values of the resistors in the first cell are each equal to $R_0$ and subsequent division by two in each cell results in a resistance value for the Nth cell equal to that shown in equation 9. Furthermore, the resolution of the circuit is defined by equation 10, the maximum resistance is equal to twice the minimum resistance and the range of possible resistances is equal the minimum resistance. Those possible resistances achievable by the network are defined by equation 6 where the magnitude of K is defined by equation 8, but with the numeric coefficients shown in equation 8 being replaced by the values $2^{N-1}$, $2^{N-2}$. . . $2^O$. This relationship shows that any resistance value between the minimum and maximum resistance can be provided with an accuracy of one half of the resolution.

As an example of a particular application of the relationships described above, suppose that a circuit design requires that a particular resistor will have to be trimmed to any value between 1,250 ohms and 1,750 ohms with an accuracy of plus or minus 15 ohms or better in order to meet the requirement. From the above description of the relationships inherent in a network such as that shown in FIG. 1, $\Delta R$ must be less than or equal to 30 ohms and the range must be greater than or equal to 500 ohms. The range of the network is equal to the minimum resistance, as shown above. Solving equations 11 and 12 for this example, the value $R_0$ is equal to 530 ohms and the magnitude of $2^N$ must be greater than or equal to 530/30 or 17.666. Since the value of N must be an integer, the designer must select N=5.

$$R_0(1-\tfrac{1}{2}^N)\geqq 500 \quad (11)$$

$$R_0/2^N\leqq 30 \quad (12)$$

According to the discussion above in association with FIG. 1, this would seem to indicate that a network with 5 cells is appropriate and the resistive value of the elements, 30 and 32, in the first cell would be equal to $R_0$ and the resistive value of the elements, 46 and 48, in the fifth cell would be equal to $R_0/16$. However, if each cell in the network of FIG. 1 comprises individual resistors of unequal value to the resistors in the other cells, a severe manufacturing problem can occur.

With reference to FIG. 3, an individual resistor 50 is shown with two conductive pads, 52 and 54, attached to it to provide a path for current to flow through the resistor 50. As is well known to those skilled in the art, a resistive element in an integrated circuit is typically manufactured by depositing a resistive solution, such as a resistive paste or ink, on a suitable substrate. Then, in order to provide the conductive path shown in FIG. 3, a pair of conductive leads are deposited in an overlapping association with the resistor as shown. With the conductive pads disposed over the end portions of the resistor 50, the resistive part of the conductive path has an effective length L and an effective width W as shown in FIG. 3. The resistance of the resistor 50 can be increased by decreasing the width W or by increasing the length L. Similarly, the resistance of resistor 50 can be decreased by increasing the width W or decreasing the length L. If the plurality of resistive elements shown in FIG. 1 comprise several different resistive magnitudes, they would also comprise several different dimensional configurations to achieve the different resistances for each of the individual cells in the network. If the resistors comprise several different sizes, it would be extremely difficult to maintain sufficiently tight tolerances to maintain the accuracy necessary to achieve the binary weighted relationships described above. For example, if one resistor in the network had dimensions L and W and another resistor had dimensions L and 2 W, and an error in manufacturing made each resistor too wide by a dimension of 0.1 W, the effects on the two resistors would be disproportionate. The widths of the two resistors, after the manufacturing deviation occurred, would be 1.1 W and 2.1 W, respectively, and the resistance of the thinner resistor would be 1.90909 times the resistance of the wider resistor rather than being twice its resistance. Therefore, it is very difficult and undesirable to manufacture a resistor network like that shown in FIG. 1 with individual resistors that are unequal in value. The desire to utilize identical resistors throughout the network of FIG. 1 can be achieved by replacing the resistive elements shown in FIG. 1 by a predetermined number of identical resistors. For example, if it is desirable to use resistors having a value of $R_0$, resistive elements 30 and 32 would each comprise a single resistor having that value. Resistive elements 34 and 36, on the other hand, must have a resistive value equal to $R_0/2$ as described above. Therefore, each of the resistive elements, 34 and 36, would be replaced by two parallel resistors which each have a resistive value of $R_0$. This procedure would be followed accordingly for each cell, or ladder, in FIG. 1 with the fifth cell 18 having each resistive element, 46 and 48, replaced by 16 individual parallel resistors that each have a value of $R_0$. In keeping with the desire to achieve a binary weighted network and also be able to achieve the resolution described above, the resistors in each ladder would be trimmed by always cutting either no resistors or half of all the resistors in each cell. As an example, the 32 resistors in the fifth cell 18 would either be left uncut or 16 of those resistors would be trimmed. This satisfies the desire to provide a binary weighted ladder network while also achieving the coincident goal of utilizing identically valued resistive elements throughout the entire network.

Since the resistance value of a single resistor, such as that shown in FIG. 3, is a function of its length and its width, the total area of an integrated circuit required for a resistor network, such as that shown in FIG. 1, is a function of the total number of resistors used to provide the network which, in turn, is a function of the individual resistance value selected for each resistor in the network. For example, FIG. 4 illustrates a hypothetical resistor ladder network that comprises three cells, 61, 62 and 63, in which each resistor shown in the network has a resistance value of $R_0$. As can be seen, the network shown in FIG. 4 requires 14 resistors to achieve a resolution equal to $R_0/8$. The identical resolution can be achieved in an alternative network which utilizes individual resistors that each have a resistive value of $R_0/2$. This is shown in FIG. 5 where the network comprises three cells, 71, 72 and 73. If each resistor in FIG. 5 is equal to one half the resistance of each resistor in FIG. 4, the networks shown in FIGS. 4 and 5 are electrically equivalent to each other. In addition, cell 61 and cell 71 are electrically equivalent to each other cell 62 is electrically similar to cell 72 and cell 63 is electrically similar to cell 73.

With continued reference to FIGS. 4 and 5, it can be seen that the network of FIG. 5 only requires the use of 10 resistors to achieve the identical electrical characteristics that required 14 resistors in FIG. 4. However, it should also be understood that since the resistors in FIG. 5 are half the value of the resistors in FIG. 4, they must either be shorter or wider than the individual resistors in FIG. 4. As described above in conjunction with FIG. 3, a resistor's value can be reduced by reducing the length L or by increasing the width W. Since the length L can not be reduced beyond a predetermined limit because of the necessity to provide a sufficient length L to permit a laser to cut the resistor along its width W, it is likely that the resistance of the resistor would be decreased by increasing its width W. Therefore, each resistor in FIG. 5 would probably have to be slightly larger than each resistor in FIG. 4. On the other hand, fewer resistors are necessary in the network in FIG. 5.

FIG. 6 illustrates this relationship between the resistance value R of each individual resistor and the total area required to contain the complete ladder network. As an example, the use of resistors having a value of $R_0$, as in FIG. 4, could hypothetically require a total area equal to $A_1$ to contain the 14 resistors of the network. By reducing the individual value of each resistor to $R_0/2$, as shown in the network of FIG. 5, the number of resistors is reduced to 10. However, if the length L of each resistor cannot be reduced to achieve the reduced resistance, the width W must be doubled. Therefore, although the number of resistors in the network was reduced by approximately 28 percent, the size of each individual resistor was doubled. Therefore, the replacement of the network shown in FIG. 4 with the network shown in FIG. 5 may actually result in an increase in total area, from $A_1$ to $A_2$, as shown in FIG. 6. Although it should be understood that these examples are hypothetical, they illustrate the complex considerations that must be examined in order to reduce the area necessary to contain the resistor ladder network.

With continued reference to the above example in which a particular resistor network was required to provide a value between 1,250 ohms and 1,750 ohms with an accuracy of plus or minus 15 ohms, it was determined that a resolution of 30 ohms was necessary and that the network required 5 cells. With N equal to 5, equations 11 and 12 provide the information that $R_0$ must be greater or equal to 560 ohms and less than or equal to 960 ohms in order to achieve the required results. The skilled artisan will understand that the lower limit for $R_0$ is set by the required range, whereas the upper limit is determined by the accuracy or resolution required. Experts will also realize that an additional series resistor will sometimes be required to complete a network. FIG. 7 illustrates the network of FIG. 1 with each resistive element, 30–48, of FIG. 1 replaced by a preselected number of identical resistors to achieve the binary weighted effect described above. The network of FIG. 7 also satisfies the requirements determined above in conjunction with the hypothetical example that wa determined to require individual resistors having a value $R_0$ between 516 ohms and 960 ohms. If a resistor value of 700 ohms is selected for each of the resistors in the five cells, 10–18, and an individual resistor 80 is added in series with the cells and has a resistance value of 500 ohms, the network shown in FIG. 7 satisfies the requirements described above. The minimum value of the circuit shown in FIG. 7 is 1,178 ohms and the maximum resistance value is 1,856 ohms. Of course, it should be understood that the range provided by the five cells in the network is between 678 ohms and 1,356 ohms and resistor 80 provides an additional resistance of 500 ohms. The resolution is smaller than 22 ohms and the accuracy is better than plus or minus 11 ohms.

Although the network shown in FIG. 7 is sufficient to satisfy the requirements of the hypothetical example described above, it should be noted that 62 resistors are necessary to satisfy the resolution requirements which necessitated the inclusion of the five cells, 10–18. It should also be noted that when the necessary resolution requires the inclusion of one more additional cell, the number of additional resistors needed for that cell is greater than the total number of resistors needed for all of the preceding cells combined. For example, with continued reference to FIG. 7, if a sixth cell is necessary to achieve a smaller desired resolution, that sixth cell would contain 64 resistors and would double the space required for the network. Therefore, it would be significantly beneficial if a network configuration required significantly fewer resistors while providing a substantially equivalent resolution.

SUMMARY OF THE INVENTION

The present invention relates to a configuration of resistive devices for permitting the achievement of a desired resistance with a required resolution between first and second circuit points in which the configuration comprises a plurality of series connected resistor ladders, or cells, with each of the resistor ladders consisting of a unique preselected number of parallel connected resistors. The preselected number for each of the resistor ladders is related to the preselected number of at least one other of the ladders by a factor of two. Most typically, the series connected resistor ladders comprise two, four, eight and sixteen resistors with the total number of binary ladders or cells being determined by the required resolution of the network. In addition to the plurality of binary cells described above, the present invention also comprises a special additional cell of resistors connected in series with the plurality of resistor sets and consisting of a nonbinary number of resistors.

In terms of the description of the present invention, a nonbinary number is one which is not within the sequence which includes the numbers two, four, eight, sixteen, thirty-two, sixty-four and so on. In other words, a nonbinary number is one which is not equal to the number 2 raised to an integer power. The particular nonbinary number selected for use in the present invention is reducible in stages to a plurality of combinations of resistors. Each of the combinations provides a resistance across the cell, or ladder, that is related to the resistances of the other combinations in a manner which results in a plurality of resistance differences or increments that are sufficiently equivalent to each other to provide a series of resistive steps which are generally monotonic and which have a greater resolution than any of the plurality of binary resistor cells connected in series with the nonbinary cell which consists of the nonbinary number of resistors.

BRIEF DESCRIPTION OF THE DRAWINGS

The present invention will be more fully understood from a reading of the Description of the Preferred Embodiment in conjunction with the drawing, in which.

DESCRIPTION OF THE PREFERRED EMBODIMENT

Figure 7:
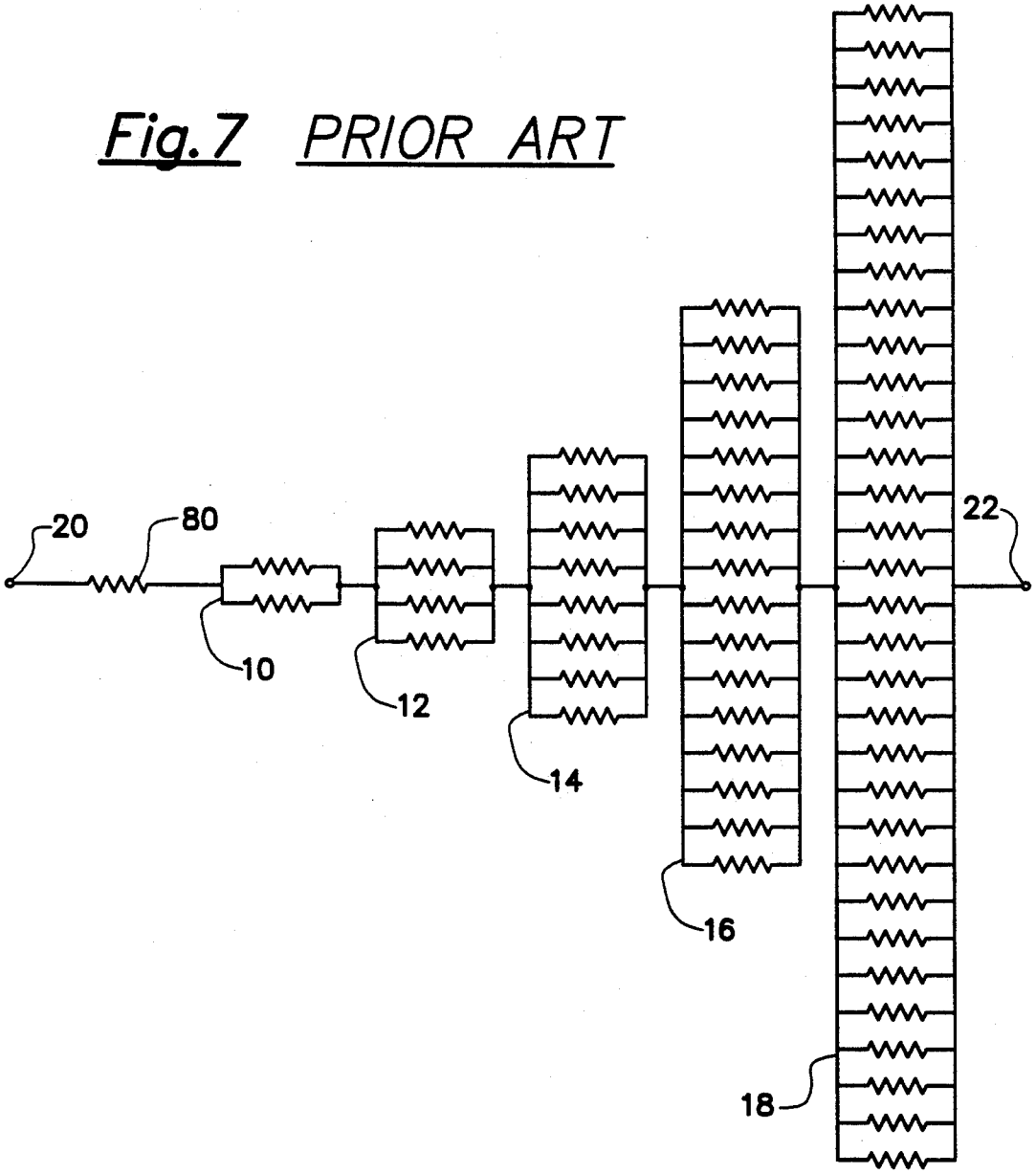
Fig. 7 PRIOR ART
FIG. 7 shows a prior art network.
Figure 8:
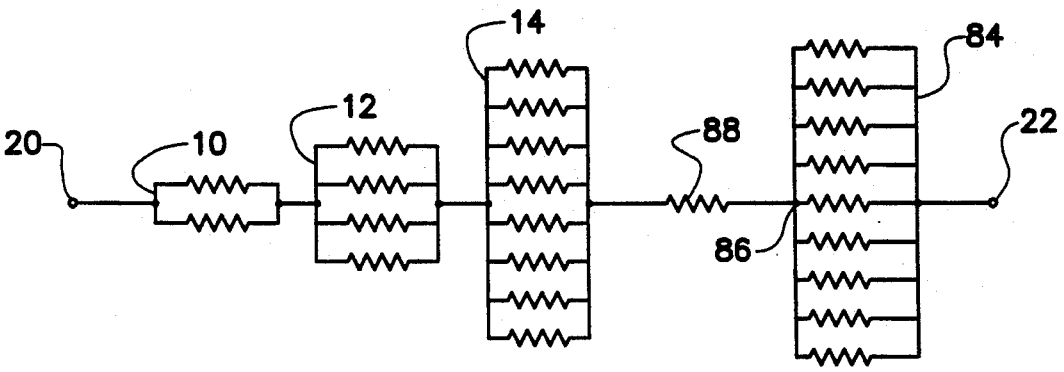
FIG. 8 shows one embodiment of the present invention.

One embodiment of the present invention will be described in conjunction with FIG. 8 which is a modification of the resistor ladder network illustrated in FIG. 7. The network of FIG. 8 comprises the first three cells, 10, 12 and 14, of the network in FIG. 7. As described above, these are the three most significant cells in the network of FIG. 7. The two least significant cells, 16 and 18, of the network shown in FIG. 7 have been removed and replaced by a special least significant stage, or cell 84, which comprises a nonbinary number of resistors connected in parallel with each other. As can be seen in FIG. 8, the nonbinary number of resistors in the special cell 84 are arranged in a ladder configuration and connected in series with the cells, 10, 12 and 14, which comprise binary numbers of resistors.

$$R_1=R_S+R_0(K_1+1)/2+(K_2+1)/4+(K_3+1)/8) \quad (13)$$

$$R_1=R_S+R_{MIN}+K(\Delta R) \quad (14)$$

The total resistance of the network shown in FIG. 8, between circuit points 20 and 22, can be defined as the resistance between circuit points 20 and 86 plus the resistance between circuit points 86 and 22. If the resistance between circuit points 20 and 86 is defined as $R_1$, it can be described by equation 13 where the values of $K_N$ in equation 13 are equal to zero if no resistors in the Nth cell are cut and equal to one if half of the resistors in cell N are cut. The relationship of equation 13 can alternatively be written as equation 14.

$$R_{MIN}=R_0(1-\tfrac{1}{8}) \quad (15)$$

$$\Delta R=R_0/8 \quad (16)$$

$$R_2=R_0/M \quad (17)$$

$$R=R_0((K_1+1)/2+(K_2+1)/4+(K_3+1)/8+A_1/9+A_2/7+A_3/6+A_4/5) \quad (18)$$

Figure 1:
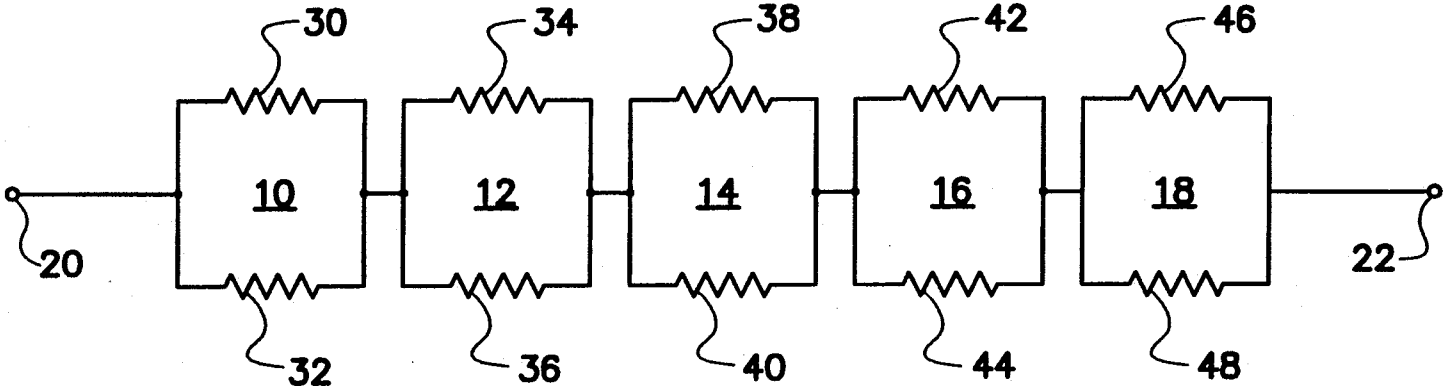
FIG. 1 shows an exemplary five cell network.
Figure 3:
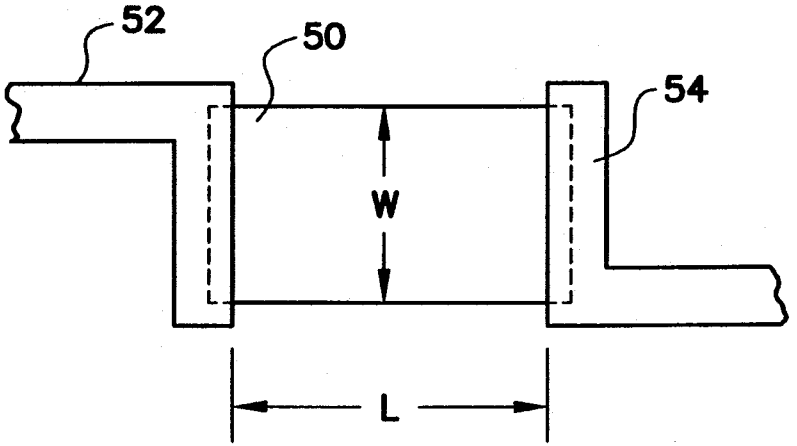
Fig. 3 PRIOR ART
FIG. 3 shows a typical deposited resistor.
Figure 2:
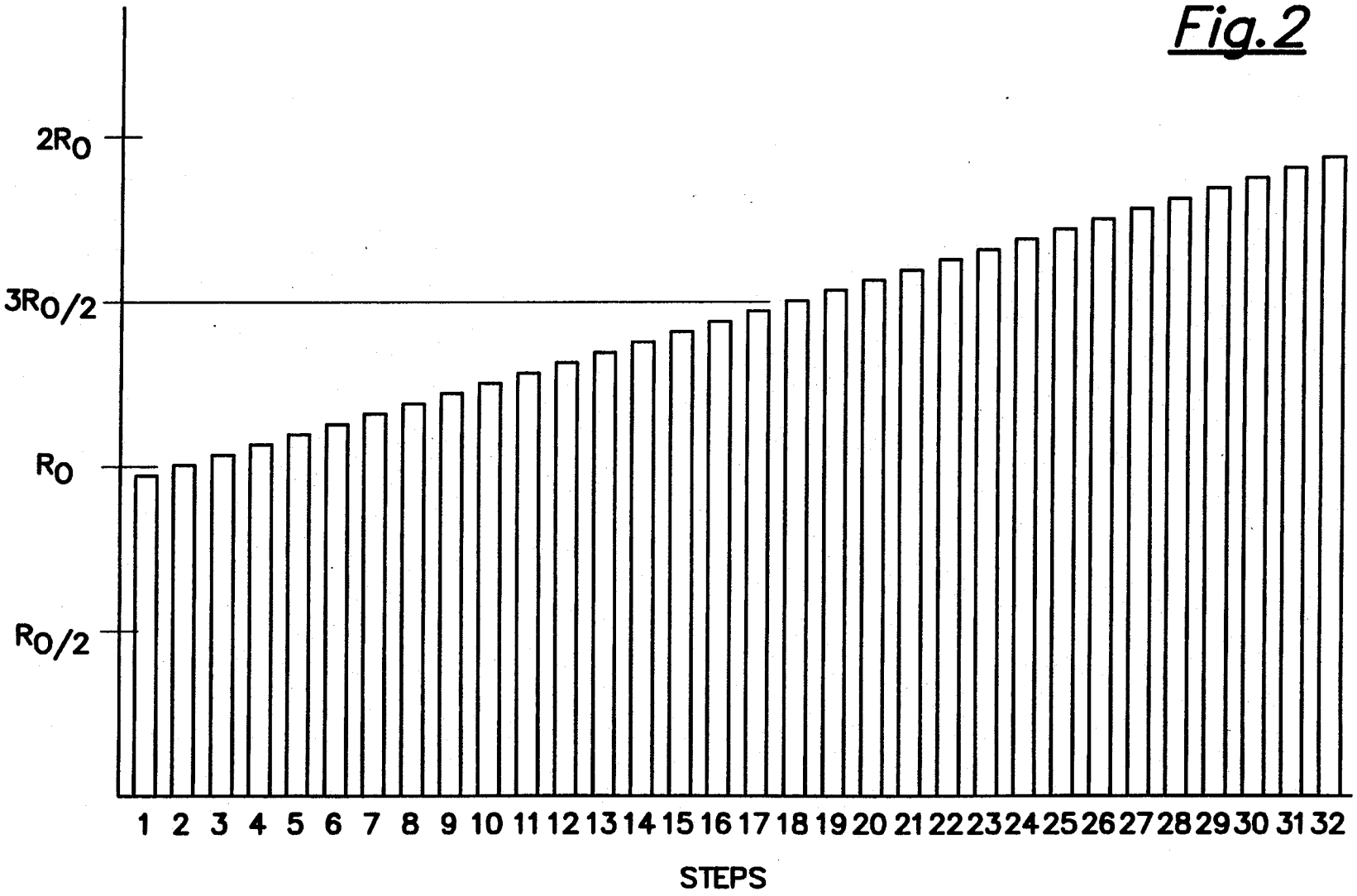
FIG. 2 is a graphical representation of the resistance steps achieve through the use of the resistor network of FIG. 1.
Figure 4:
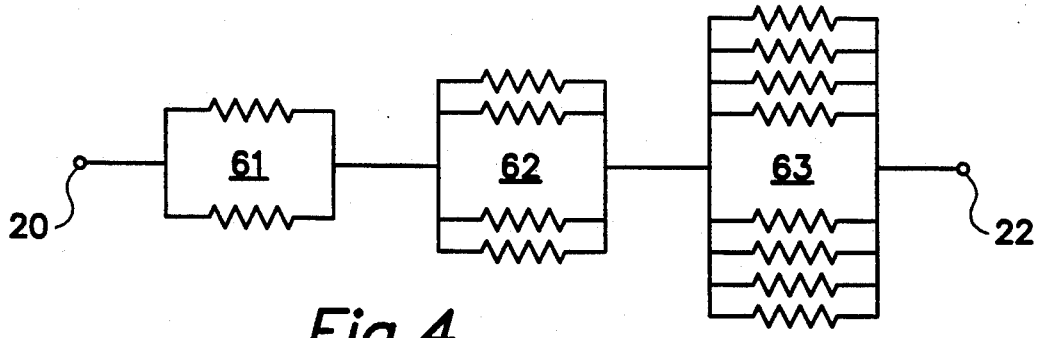
FIG. 4 shows an exemplary prior art resistor network.
Figure 5:
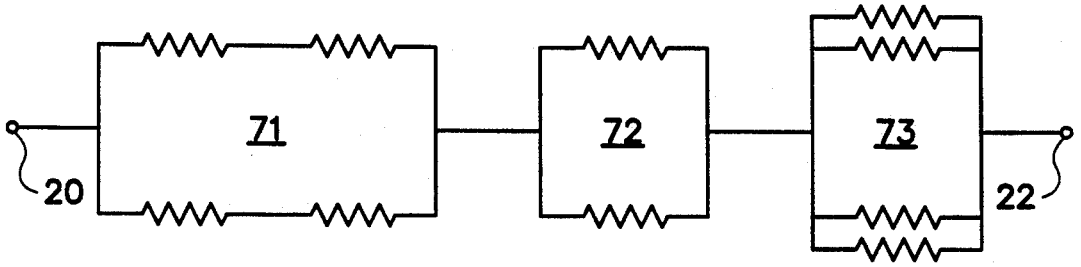
FIG. 5 is an equivalent network to that shown in FIG. 4.
Figure 6:
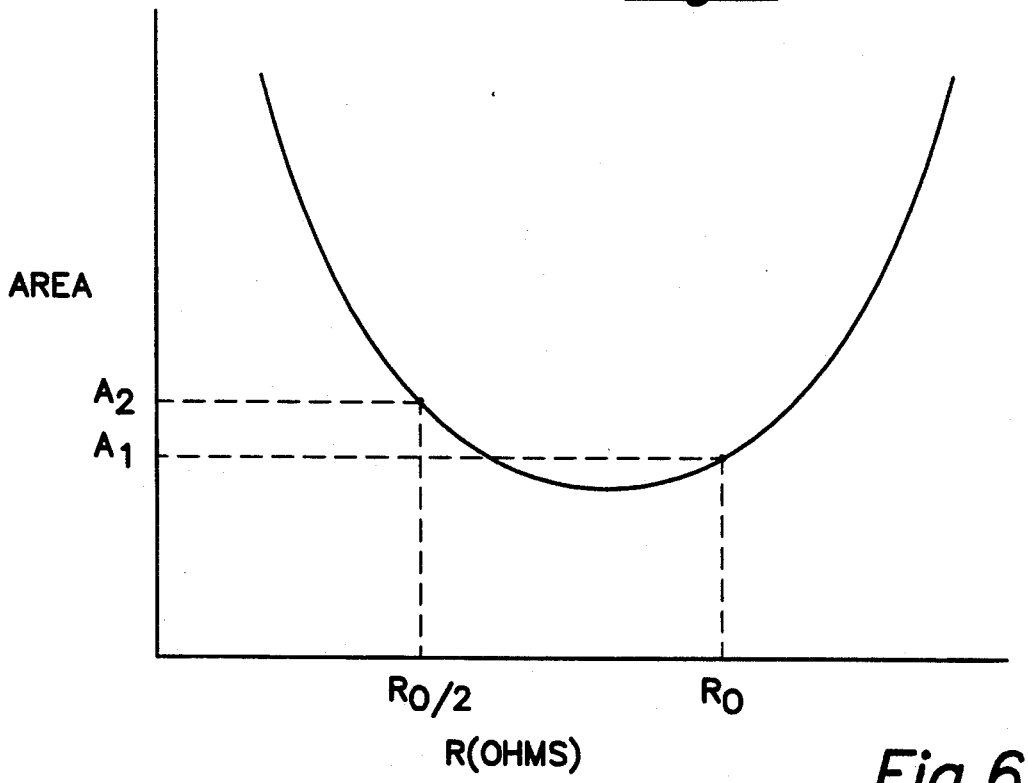
FIG. 6 illustrates the relationship between resistor value and the area required to contain the network of resistors.
Figure 12:
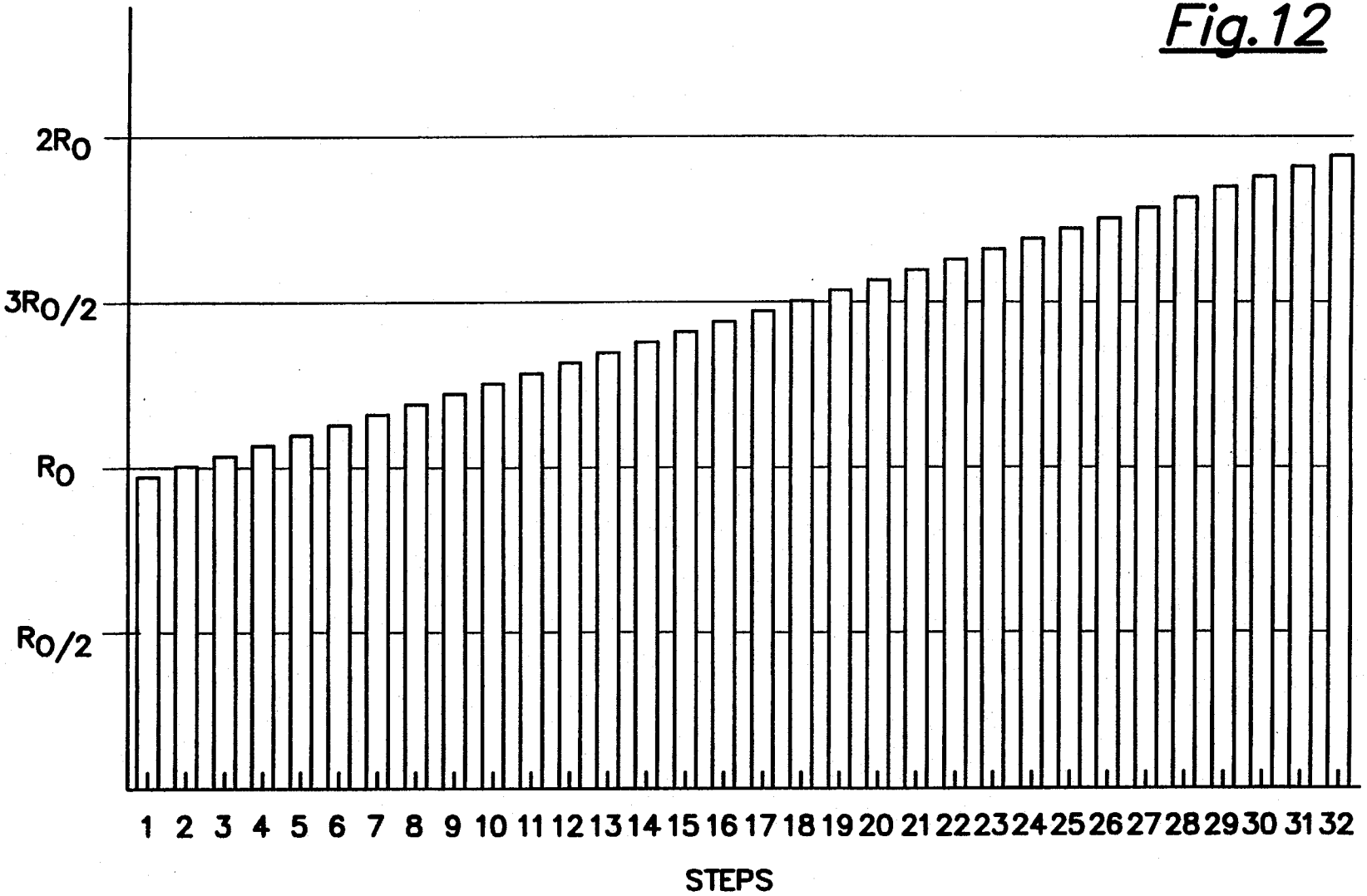
FIG. 12 shows the steps available with the network of FIG. 8.
Figure 13:
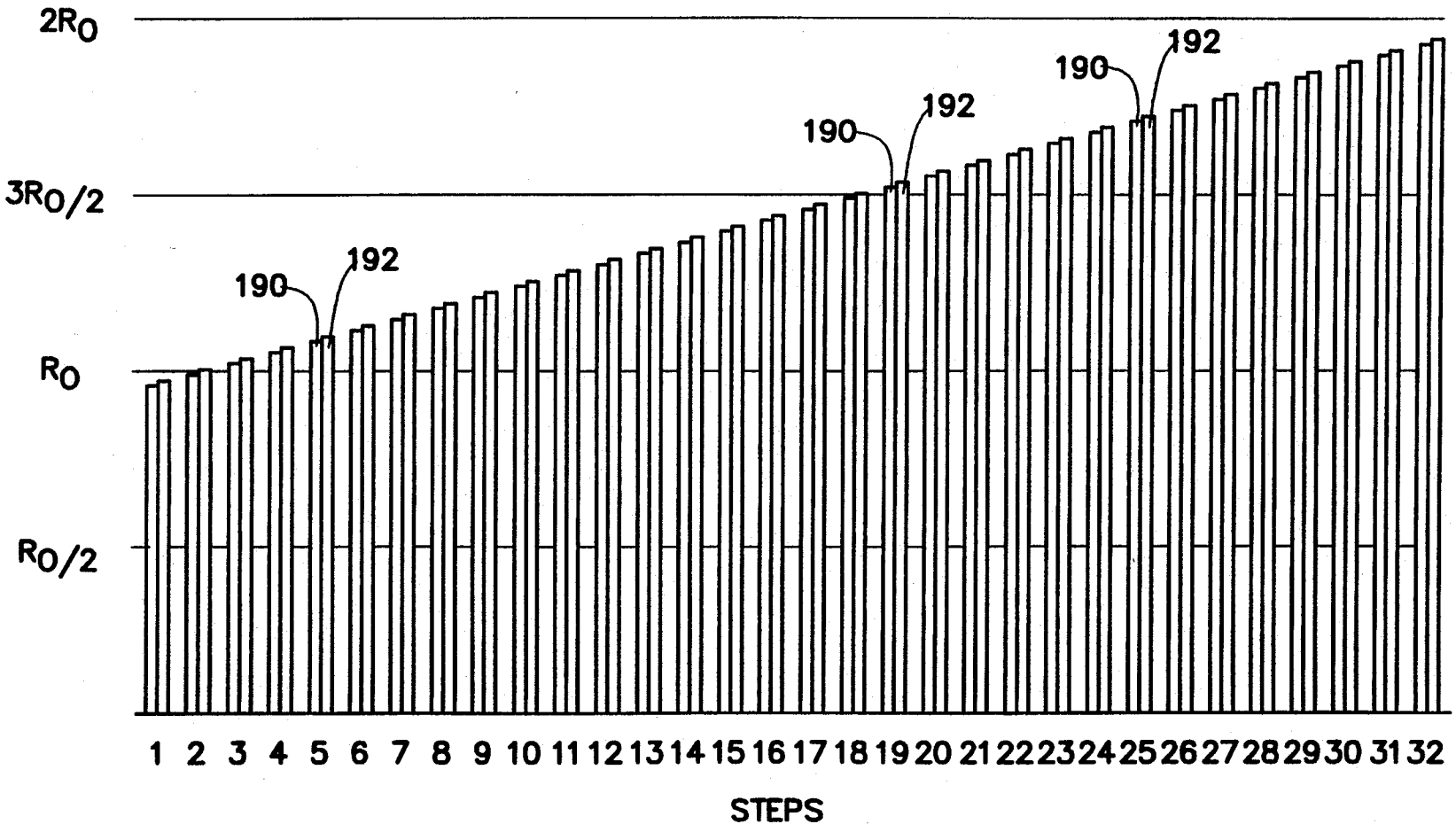
FIG. 13 is a graphical comparison of the resistive steps available with the networks of FIGS. 7 and 8.

With continued reference to the portion of the circuit between circuit points 20 and 86 in FIG. 8, equation 15 represents the minimum resistance between those circuit points and equation 16 describes the resolution of that portion of the network. If the resistance between circuit points 86 and 22 is defined as $R_2$, it can be described by equation 17 where M is the number of uncut resistors in the nonbinary cell 84. For example, if no resistors are trimmed from the nonbinary cell 84, the value of $R_2$ is $R_0/9$, if two resistors are trimmed the resistance between circuit points 86 and 22 is $R_0/7$, if three resistors are trimmed the resistance is equal to $R_0/6$ and if four resistors are trimmed the resistance between circuit points 86 and 22 is equal to $R_0/5$. The difference in resistance $R_2$ between trimming no resistors and trimming two resistors is equal to $R_0(1/31.5)$. The difference between trimming two resistors and trimming three resistors is a change in resistance equal to $R_0(1/42)$. The difference in resistors $R_2$ between trimming three resistors and trimming four resistors is $R_0(1/30)$. It can be seen that each of these three differences in resistance between sequential steps is substantially equal to, but not precisely equal to $R_0(1/32)$. Therefore, the resolution provided by the nine resistors in the nonbinary cell 84, when trimmed in the particular combination of no resistors, two resistors, three resistors and four resistors, yield a resolution that is substantially similar to the resolution that could have been obtained through the use of the fourth and fifth binary cells, 16 and 18, shown in FIG. 7. Not every nonbinary number of resistors can be connected in a ladder arrangement to yield this capability. One embodiment of the present invention comprises nine resistors such as the ladder 84 shown in FIG. 8. This particular nonbinary number permits the resistors to be trimmed in four specific combinations which yield resistances across the ladder that differ from each other by magnitudes that are generally, although not precisely, equal to each other and provide a resolution that is sufficiently similar to the resolution that is otherwise obtainable through the use of a significantly larger number of resistors to achieve the required resolution with an acceptable accuracy. Comparing FIGS. 7 and 8, it can be seen that the present invention provides this substantially similar resolution and accuracy while requiring 39 fewer resistors than the network shown in FIG. 7. It accomplishes this result by replacing the 48 resistors in cells 16 and 18 of FIG. 7 with the nine resistors in cell 84 of the network shown in FIG. 8. FIG. 12 shows the 32 steps that can be achieved with the embodiment of the present invention shown in FIG. 8. Comparison of FIGS. 2 and 12 illustrate the similarity of results between the circuits of FIGS. 7 and 8, respectively. FIG. 13 shows a comparison of the thirty two steps 190 of the prior art circuit of FIG. 7 and the thirty two steps 192 of the present invention of FIG. 8. As can be seen, the resolution of the present invention is substantially similar even though significantly fewer resistors were required.

If the series resistance $R_S$ of resistor 88 is ignored, the resistance between circuit points 20 and 22 in FIG. 8 can be described by equation 18 where $K_N$ and $A_N$ have the values of zero or one and only one of the $A_N$ terms can be equal to unity at any time. The accuracy of the network is governed by the largest resolution of among the four resistor combinations available with the nonbinary cell 84, as identified by the last four terms of equation 18. The four combinations in the nonbinary cell 84 yield resistances of $R_0/9$, $R_0/7$, $R_0/6$ and $R_0/5$. Between these four steps, the incremental changes in resistance are $R_0/31.5$, $R_0/42$ and $R_0/30$.

When the network of the present invention shown in FIG. 8 is used, the largest incremental differential resistance occurs between steps 4 and 5, 8 and 9, 12 and 13, 16 and 17, 20 and 21, 24 and 25 or 28 and 29 which are illustrated in FIG. 12. This differential resistance occurs when the status of cell 14 is changed and the status of cell 84 is also changed from 4 resistors being trimmed to no resistors being trimmed. Using the change in resistance between steps 4 and 5 as an example, the total resistance of step 4 is shown in equation 19 and the total resistance of step 5 is shown in equation 20.

$$R_4 = R_0/2 + R_0/4 + R_0/8 + R_0/5 \quad (19)$$

$$R_5 = R_0/2 + R_0/4 + R_0/4 + R_0/9 \quad (20)$$

The resistance of step 4 if therefore $43R_0/40$ and the resistance of step 5 is therefore $40R_0/36$. The difference is equal to $52R_0/1440$ which is $R_0/27.6923$ or $0.03611R_0$. Since the effective resolution of any network is determined by the largest possible differential between any two sequential steps, the resolution of the circuit of FIG. 8 is $R_0/27.6923$ which is slightly greater than the resolution of the prior art network shown in FIG. 7. However, the resolution of the present invention is achieved with significantly fewer resistors.

Figure 9A:
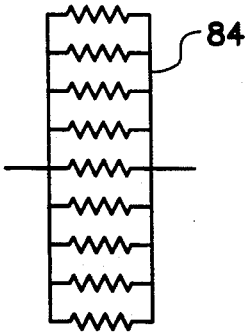
FIGS. 9A-9D show the possible combinations achievable through the use of the present invention.
Figure 9B:
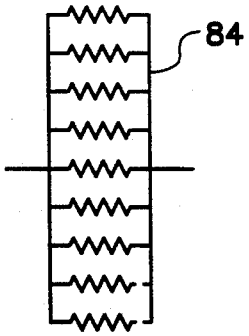
Figure 9C:
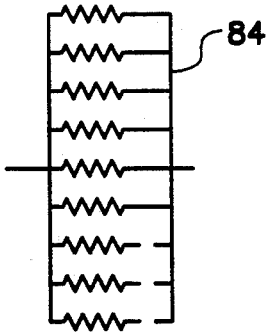
Figure 9D:
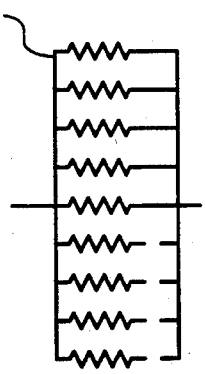

FIGS. 9A, 9B, 9C and 9D show the four combinations of resistors available through the use of the present invention. FIG. 9A shows the nonbinary ladder 84 with no resistors cut to yield a resistance across the ladder of $R_0/9$. FIG. 9B shows two resistors trimmed to provide a resistance across the ladder of $R_0/7$. FIGS. 9C and 9D show three and four resistors trimmed, respectively, to yield resistance across the ladder of $R_0/6$ and $R_0/5$. FIGS. 9A–9D represent the four combinations that are achievable through the use of the present invention that result in incremental resistance changes which are substantially similar to the resolution that is provided by the known resistor network shown in FIG. 7.

Figure 10:
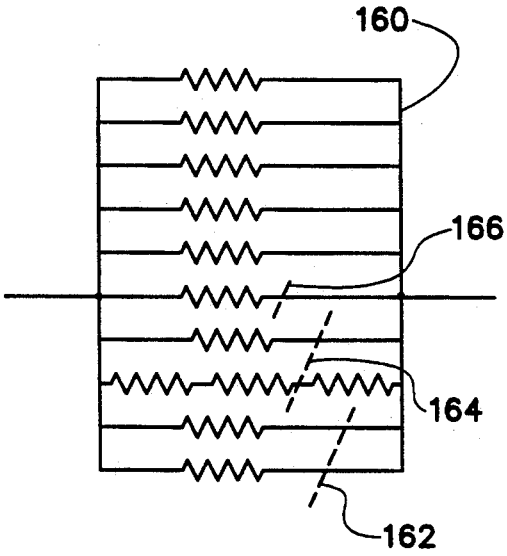
FIGS. 10 and 11 illustrate alternative embodiments of the present invention.
Figure 11:
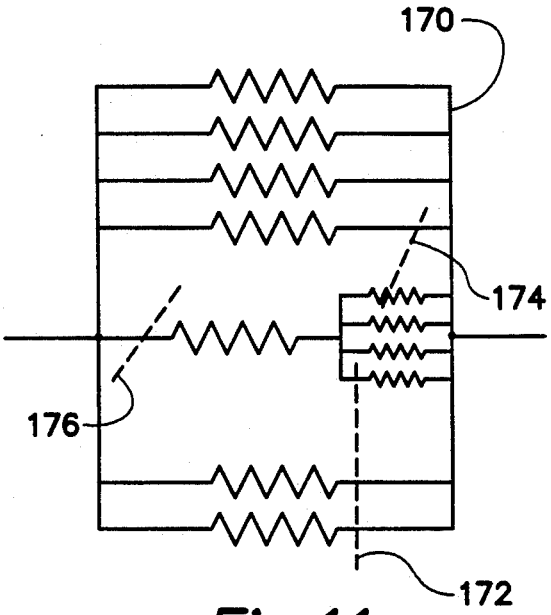

To illustrate that the present invention is not restricted to the embodiment illustrated in FIG. 8, two additional alternative embodiments of the present invention are shown in FIGS. 10 and 11. The embodiment shown in FIG. 10 is a cell 160, or resistor ladder, which could be used instead of the ladder 84 shown in FIG. 8. It comprises a nonbinary number of resistors with one of the legs comprising three times the resistance of the other legs. To achieve the plurality of combinations, the cell 160 can be successively reduced by severing two resistors as indicated by dashed line 162, by severing two additional legs as illustrated by dashed line 164 and by severing one more leg as indicated by dashed line 166. This results in a resistance for the group of resistors 160 which is equal to $R_0/9.33$, $R_0/7.33$, $R_0/6.0$ and $R_0/5.0$. The incremental resistance differences between the four steps, or combinations, illustrated in FIG. 10 are $R_0/34.2222$, $R_0/33.0$, $R_0/30.0$ and $R_0/31.1111$ which is the resistance difference between cell 160 trimmed at dashed lines 162, 164 and 166 and cell 160 untrimmed, but with four of the eight resistors in the next more significant cell 14 (illustrated in FIG. 8) being trimmed. As can be seen, these steps provide a resolution which is extremely similar to the steps of $R_0/32$ available with the prior art resistor ladder network shown in FIG. 7. Use of the cell 160 shown in FIG. 10 permits the 48 resistors in the two least significant cells, 16 and 18, to be replaced with the 12 resistors of cell 160. This is a reduction of 36 resistors and a significant contraction of the necessary area of an integrated circuit to contain the resistor ladder network.

Another embodiment of the present invention is shown in FIG. 11. Six of the individual resistors are connected in parallel with each other as shown. In addition, four other resistors are connected in parallel with each other and in series with another resistor, with the combination being connected in parallel with the other six resistors of the cell 170. The resistors can be severed at the point indicated by dashed lines 172, 174 and 176 to result in three combinations of resistors in addition to the full combination shown in FIG. 11, wherein no resistors are severed from the arrangement. If no resistors are severed, the resistance of the total arrangement of FIG. 11 is equal to $R_0/6.8$. If the two resistors are severed at line 172, the remaining resistors combine to yield a resistance of $R_0/4.75$. If only those resistors affected by dashed lines 174 and 172 are severed from the arrangement, the resulting resistance of the ladder is $R_0/3.667$. If all of the resistors affected lines 172, 174 and 176 are removed from the ladder, the remaining resistors yield a resistance equal to $R_0/3.0$ where $R_0$ is the value of each of the individual resistors shown in FIG. 11.

The combinations of resistors illustrated in FIG. 11 provide four steps which each have a different and unique resistance value. The differential resistances between steps are $R_0/15.756$, $R_0/16.077$, $R_0/16.50$ ohms and $R_0/15.692$, respectively. These incremental resistance differences are extremely similar to each other and provide substantially equal differences between sequential steps provided by the embodiment illustrated in FIG. 11. While not precisely equal in magnitude, these steps permit the resistor network to provide a monotonic progression of values that are similar to the values that could otherwise be obtained through the use of the two cells, 14 and 16, in FIG. 7. It should be understood that the two alternative embodiments shown in FIGS. 10 and 11 are intended for use with three binary ladder cells, such as those identified by reference numerals 10, 12 and 14, connected in series with the nonbinary cell, 160 or 170, of the present invention. Each of the embodiments shown in FIGS. 10 and 11 replace the 48 resistors of cells 16 and 18 while providing a substantially similar resolution and accuracy capability. The embodiment shown in FIG. 10 replaces the 48 resistors with 12 resistors and the embodiment shown in FIG. 11 replaces the 24 resistors of cells 14 and 16 with 11 resistors.

The present invention takes advantage of the fact that certain nonbinary numbers of resistors can be selected and disposed in an arrangement to form a ladder, or cell, of resistors. More importantly, specific nonbinary numbers of resistors can be chosen so that they can be selectively severed to reduce the number of resistors into four unique combinations, wherein the combinations provide four resistances which differ from each other in a pattern which yields resistance differences, or increments, that are generally equivalent. It is recognized that precise equivalence is not achievable within a range of reasonable options for the circuit designer. However, the present invention takes advantage of the fact that substantial similarity can be achieved between successive resistance steps and that this similarity permits a pseudobinary series of resistances to be achieved. In other words, although each resistive increment achieved through the use of the present invention is not precisely equal to each and every other increment in the sequence, the difference from perfect uniformity is sufficiently small to permit one or more binary resistor ladders to be effectively simulated and replaced with a significantly reduced number of resistors. Although three embodiments of the present invention are shown in the Figures and discussed above, it should be realized that other embodiments of the present invention are possible. In addition, although the present invention has been described in detail with respect to an association with three binary sets, such as those identified by reference numerals 10, 11 and 12, it should be understood that alternative embodiments of the present invention are possible for use in association with greater numbers of binary resistor ladders. Although the embodiment shown in FIG. 8 is generally equivalent in resolution capacity to the prior art network shown in FIG. 7, alternative embodiments of the present invention could comprise four known binary ladders in combination with a nonbinary cell which achieves a resolution that is generally similar to a completely binary network that comprises six or more cells of resistors with the sixth cell consisting of sixty-four resistors. The primary concept of the present invention which makes it possible to achieve this degree of resolution with a significantly reduced number of resistors is the fact that the nonbinary number of resistors in the group of resistors is specifically selected to permit the number of resistors to be sequentially reduced to result in four unique combinations of resistors which, in turn, each yield a resistance that differs from the other combinations by generally equal increments.

The embodiments of the invention in which an exclusive property or right is claimed are defined as follows:

1. A resistor network for providing a desired resistance between first and second circuit points, comprising:

a plurality of series connected resistor cells, each of said plurality of series connected resistor cells comprising a preselected number of parallel connected resistors which is related to the preselected number of resistors of at least one other of said plurality of resistor cells by a factor of two; and a group of resistors connected in series with said plurality of resistor cells and comprising a nonbinary number of resistors, said nonbinary number being reducible in stages to a plurality of combinations, each of said combinations having a resistance that is related to the resistances of the other combinations in a manner which results in a plurality of resistance differences that are sufficiently equivalent to each other to provide a series of incremental resistive steps which are generally monotonic and have a greater resolution than any of said plurality of resistor cells.

2. The network of claim 1, wherein:

a first one of said resistor cells comprises two resistors; and a second one of said resistor cells comprises four resistors.

3. The network of claim 2, wherein:

a third one of said resistor cells comprises eight resistors.

4. The network of claim 3, wherein:

said group of resistors consists of nine resistors.

5. The network of claim 4, wherein:

said nine resistors are reducible to combinations of seven, six and five resistors.

6. The network of claim 1, wherein:

all of said resistors in said group of resistors are connected in parallel with each other.

7. The network of claim 1, wherein:

every one of said resistors of said plurality of cells and of said group is of a generally equal resistive value.

8. A resistor network configuration, comprising:

a plurality of series connected resistor cells, each of said cells comprising a preselected number of parallel connected resistors which is numerically related to the preselected number of resistors of at least one other of said cells by a factor of two; and a group of parallel connected resistors, said group being connected in series with said plurality of series connected resistor cells, said group comprising a nonbinary number of parallel connected resistors, said nonbinary number being selected to provide a preselected number of potential subgroupings, said preselected number of potential subgroupings resulting in a preselected number of monotonic resistances.

9. The configuration of claim 8, wherein:

a first of said resistor cells consists of two resistors; and a second of said resistor cells consists of four resistors.

10. The configuration of claim 9, wherein:

a third of said resistor cells consists of eight resistors.

11. The configuration of claim 8, wherein:

said group consists of nine resistors.

12. The configuration of claim 11, wherein:

said nine resistors are connected in parallel with each other.

13. The configuration of claim 8, wherein:

one of said parallel connected resistors of said group comprises a plurality of resistive components connected in series with each other.

14. The configuration of claim 8, wherein:

one of said parallel connected resistors of said group comprises a subgroup of parallel connected resistive components connected in series with another resistive component.

15. The configuration of claim 14, wherein:

all resistors and resistive components are of an equal resistance value.

16. A configuration of resistors, comprising:

a first cell of two parallel connected resistors;

a second cell of four parallel connected resistors;

a third cell of eight parallel connected resistors; and a fourth cell of nine parallel connected resistors, said first, second, third and fourth cell being connected in series with each other between first and second circuit points.

17. The configuration of claim 16, wherein:

two of said nine resistors are disconnected from current carrying association within said configuration.

18. The configuration of claim 16, wherein:

three of said nine resistors are disconnected from current carrying association within said configuration.

19. The configuration of claim 16, wherein:

four of said nine resistors are disconnected from current carrying association within said configuration.

* * * * *